United States Patent [19]

Raap

[11] Patent Number: 4,645,165

[45] Date of Patent: Feb. 24, 1987

[54] PICTURE HANGER

[75] Inventor: Gerald G. Raap, Alexandria, Minn.

[73] Assignee: Donald F. Kutz, Alexandria, Minn.

[21] Appl. No.: 758,397

[22] Filed: Jul. 24, 1985

[51] Int. Cl.[4] ..... A47G 1/24

[52] U.S. Cl. ..... 248/476; 40/152; 40/152.1; 248/214; 248/495

[58] Field of Search ..... 248/476, 495, 497, 489, 248/214, 298, 307, 323; 40/152.1, 152, 153, 158 R

[56] References Cited

U.S. PATENT DOCUMENTS

| | | | |
|---|---|---|---|
| 779,433 | 1/1905 | Long | 248/496 |
| 989,612 | 4/1911 | Kohn | 248/495 |
| 2,483,114 | 9/1949 | Van Schoor et al. | 248/496 |
| 2,657,887 | 11/1953 | White | 248/495 |
| 2,740,603 | 4/1956 | Wofford | 248/494 |
| 2,893,666 | 7/1959 | Cousins | 248/476 |
| 3,169,738 | 2/1965 | Johnson | 248/496 |
| 3,337,926 | 8/1967 | Daugherty | 248/489 |
| 3,630,476 | 12/1971 | Lococo | 248/476 |
| 3,838,842 | 10/1974 | McCracken | 248/476 |
| 3,945,599 | 3/1976 | Spier et al. | 248/476 |
| 4,171,117 | 10/1979 | Prochaska | 248/495 |
| 4,258,893 | 3/1981 | Tolley | 248/214 X |

*Primary Examiner*—Ramon O. Ramirez

*Attorney, Agent, or Firm*—Harvey B. Jacobson

[57] ABSTRACT

A picture hanger comprises a bar for attachment to the rear of a picture frame and a collar slidable on the bar. The collar has a notch for suspension on a wall-mounted picture hook. When the collar is suspended on the hook, the bar can be moved in the collar to adjust and level the picture.

3 Claims, 4 Drawing Figures

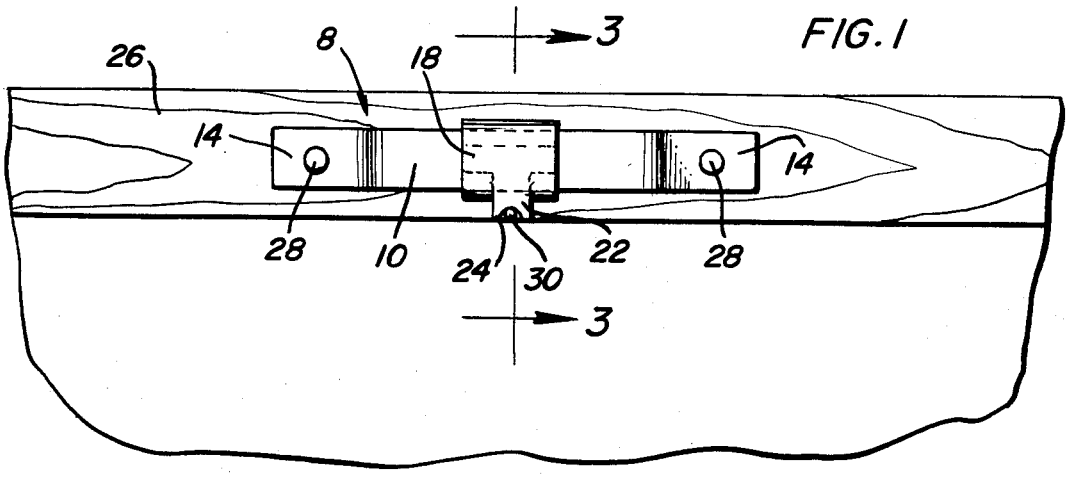
FIG. 1
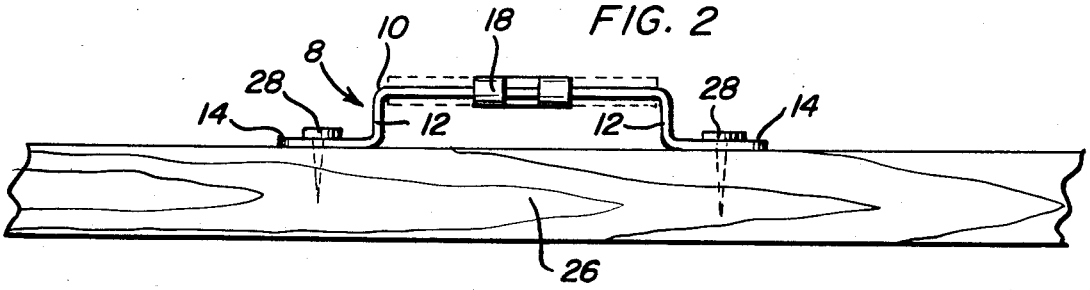
FIG. 2
FIG. 3
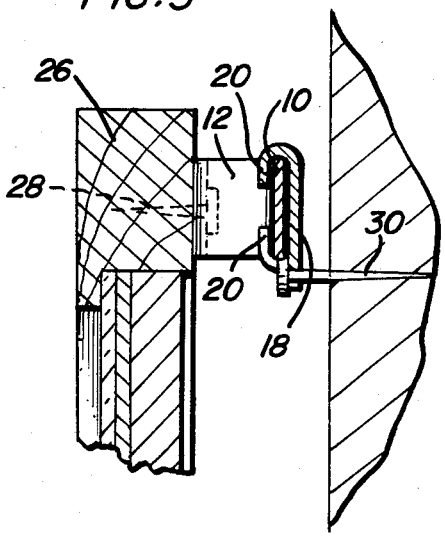
FIG. 4
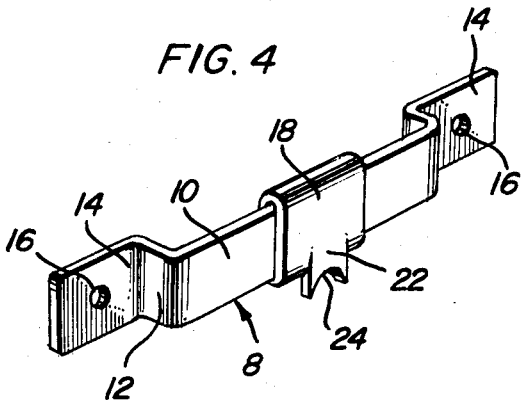

PICTURE HANGER

BACKGROUND OF THE INVENTION

This invention relates to a hanger attachment for pictures and the like generally for facilitating the hanging thereof on a wall. In this respect, an attachment in accordance with the invention is simple to secure to the back of a picture and also is expeditious in obtaining proper leveling of the picture when hanging same. The invention will be described herein in relation to pictures in order to simplify the description thereof. It is to be understood, however, that the term "picture" is used generally to include any relatively rigid wall hanging such as a painting, photograph, clock, mirror, plate, or the like.

Pictures are commonly hung on the wall by means of a cord, wire or the like secured across the back of the picture by fastener eyes on opposite sides of the picture frame, the wire or cord being suspended on one or more picture hooks embedded in a wall. Difficulty may be experienced in attaching a cord or wire to a back of a picture, particularly in a neat, unobtrusive and secure manner, and difficulty may also be encountered in leveling the picture during mounting by moving the cord or wire along the hook.

The present invention provides a hanger attachment for pictures and the like which dispenses with the need for a cord or wire, which is simple to attach to a picture, and which facilitates leveling of the picture when suspending same by means of the attachment on a wall-mounted hook.

STATEMENT OF THE PRIOR ART

Applicant is aware of the following U.S. patents relating to picture hanging appliances and the like. None of the patents, however, discloses a device having the features of the present invention.

U.S. Pat. No. 779,433, J. A. Long, Jan. 10, 1905;
U.S. Pat. No. 2,483,114, E. H. Van Schoor et al, Sept. 27, 1949;
U.S. Pat. No. 2,740,603, J. S. Wofford, April 3, 1956;
U.S. Pat. No. 3,169,738, N. L. Johnson, Feb. 16, 1965;
U.S. Pat. No. 3,838,842, R. N. McCracken, Oct. 1, 1974;
U.S. Pat. No. 3,945,599, I. M. Spier et al, Mar. 23, 1976.

SUMMARY OF THE INVENTION

A picture hanger in accordance with the invention comprises a substantially straight bar, means at opposite ends of the bar for attaching same to the back of a picture or the like with a degree of clearance between the bar and the rear surface of the picture, a collar slidably mounted on the bar for adjusting movement therealong, and a locating formation, such as a notch, on the base of the collar for suspending the attachment from a wall-mounted hook and the like. The attachment means may comprise flanges at opposite ends of the bar with holes for screws, tacks or the like.

In use, the attachment may be secured to the rear of a picture frame or the like near the top of the frame and substantially in the center thereof with the bar extending horizontally. The locating formation (notch) is then suspended on a wall-mounted hook, nail or the like. To level the picture, the bar may be moved in either direction through the collar until an appropriate position of balance is found.

The attachment is simple and economical to manufacture, and it is simple to attach and use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a rear elevational view of a part of a picture provided with a hanger attachment in accordance with the invention.

FIG. 2 is a plan view of the combination shown in FIG. 1.

FIG. 3 is a sectional view on line 3—3 of FIG. 1.

FIG. 4 is a perspective view of the hanger attachment.

DESCRIPTION OF THE PREFERRED EMBODIMENT

A hanger attachment 8 in accordance with the invention comprises a steel bar 10 of sheet material bent at its opposite ends to form shoulders 12 and flanges 14 with nail or like holes 16. The length of the bar between the bends may be about 2 inches. Its width may be about $\frac{3}{8}$ inch to $\frac{1}{2}$ inch. Slidably mounted on bar 10 is a collar 18 which may be formed from the same material, the collar being bent over to form ribs 20 which grip around the back of the bar, while allowing sliding adjustment movement of the bar and collar lengthwise the bar. The collar has a central portion 22 below bar 10 formed with a downwardly facing notch 24 or like locating formation.

In use, attachment 8 may be secured to the rear surface of picture frame 26 near the top of the frame and substantially centrally thereof by means of tacks 28 or the like, the hanger being attached with bar 10 extending substantially horizontally. It is understood that shoulders 12 provide a degree of clearance between the bar and the rear surface of the frame to allow unimpeded adjusting movements of the bar 10 and collar 18.

The picture is suspended on a wall-mounted hook 30 or the like by placing notch 24 of the collar on the hook, and if the picture does not initially hang level, its level may simple and expeditiously be adjusted by lengthwise movement of bar 10 in the collar. When released, the weight of the picture will hold the bar in adjusted position in the collar. The hanger may also be made of materials other than steel and may be used on items other than pictures.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. A hanger for a picture or like hanging article comprising a substantially straight bar, means at opposite ends of the bar for attaching same to a rear surface of the article with a degree of clearance between the surface and the bar, a collar slidingly mounted on the bar for relative lengthwise adjustment movements of the bar and collar and a locating formation on the collar for suspending the attachment on a wall-mounted hook and the like, said collar having a first portion gripping the bar top and bottom and a second portion extending below the bar, the locating formation comprising a notch extending upwardly from a lower edge of said second portion.

2. The invention of claim 1 wherein the mean at opposite ends of the bar for attaching same to a rear surface of an article comprise respective bends in the bar defining shoulders and flanges with nail holes, the flanges being disposed in parallel with the bar.

3. The invention of claim 2 wherein the bar is bent to shape from sheet material.

* * * * *